US007556570B2

(12) United States Patent
Thörmer

(10) Patent No.: US 7,556,570 B2
(45) Date of Patent: Jul. 7, 2009

(54) TRAINING APPARATUS FOR GOLF SWING

(76) Inventor: Dieter Thörmer, An der Schmitte 5, D-40721 Haan (DE)

( * ) Notice: Subject to any disclaimer, the term of this patent is extended or adjusted under 35 U.S.C. 154(b) by 459 days.

(21) Appl. No.: 10/563,529

(22) PCT Filed: Jun. 30, 2004

(86) PCT No.: PCT/DE2004/001372

§ 371 (c)(1),
(2), (4) Date: Mar. 16, 2006

(87) PCT Pub. No.: WO2005/002687

PCT Pub. Date: Jan. 13, 2005

(65) Prior Publication Data

US 2006/0160635 A1 Jul. 20, 2006

(30) Foreign Application Priority Data

Jul. 2, 2003 (DE) ..... 103 29 920
Nov. 26, 2003 (DE) ..... 103 55 174

(51) Int. Cl.
*A63B 69/36* (2006.01)

(52) U.S. Cl. ..... 473/259; 473/258

(58) Field of Classification Search ..... 473/258–260
See application file for complete search history.

(56) References Cited

U.S. PATENT DOCUMENTS 1,567,530 A * 12/1925 MacNaughton et al. ..... 473/229
1,634,102 A * 6/1927 Hansen ..... 473/229
1,944,942 A * 1/1934 MacDonald ..... 473/259
1,960,787 A * 5/1934 MacStocker ..... 473/229
3,339,927 A * 9/1967 Nunn ..... 473/258
3,711,103 A * 1/1973 Seltzer ..... 473/229
3,953,035 A * 4/1976 Beckisk ..... 473/229
4,583,740 A * 4/1986 Ohly ..... 473/259
4,949,974 A * 8/1990 Bellagamba ..... 473/216
5,026,065 A * 6/1991 Bellagamba ..... 473/216
5,072,942 A * 12/1991 Hurley ..... 473/229

(Continued)

FOREIGN PATENT DOCUMENTS

GB 2 280 118 1/1995

(Continued)

OTHER PUBLICATIONS

International Search Report.

*Primary Examiner*—Raleigh W. Chiu
(74) *Attorney, Agent, or Firm*—Collard & Roe, P.C.

(57) ABSTRACT

The invention relates to a training apparatus (1) for optimizing a golf swing. The apparatus consists of at least one guide ring, which is positioned on a plane that is inclined in relation to the vertical by means of a support. The apparatus is characterized in that it is provided with two guide rings (2, 3), which are arranged approximately on the same plane, and which are held at least in certain sections in a support (4) at a distance from one another. The two guide rings (2, 3) are approximately elliptical and are designed to support a golf club. The training apparatus (1) enables a golfer to improve his or her swing by maintaining contact between the golf club and the two guide rings when following the ideal line.

20 Claims, 5 Drawing Sheets

U.S. PATENT DOCUMENTS

| | | | | |
|---|---|---|---|---|
| 5,895,327 | A | 4/1999 | Francisco | |
| 5,984,798 | A | 11/1999 | Gilmour | |
| 7,144,340 | B1 * | 12/2006 | Jones et al. | 473/409 |
| 2006/0160635 | A1 * | 7/2006 | Thormer | 473/259 |

FOREIGN PATENT DOCUMENTS

| | | |
|---|---|---|
| JP | 2001-104531 | 4/2001 |
| WO | WO 02/15984 | 2/2002 |

* cited by examiner

TRAINING APPARATUS FOR GOLF SWING

CROSS REFERENCE TO RELATED APPLICATIONS

Applicant claims priority under 35 U.S.C. §119 of German Applications Nos. 103 29 920.3, filed on Jul. 2, 2003 and 103 55 174.3, filed on Nov. 26, 2003. Applicant also claims priority under 35 U.S.C. §365 of PCT/DE2004/001372 filed on Jun. 30, 2004. The international application under PCT article 21(2) was not published in English.

BACKGROUND OF THE INVENTION

1. Field of the Invention

The invention relates to a training apparatus for exercising golf swings that consists of at least one guide ring that is positioned by means of a support in a plane extending inclined in relation to the vertical.

2. Prior Art

It is known that swinging a golf club can be learned by receiving instructions from a trainer, or with the help of training equipment. As a rule, training devices for learning how to swing a golf club are based on restricting the locomotor system of the golfer in order to cause him or her to dispense with degrees of freedom in carrying out movements that are not ideal, and thus lead to an optimized golf swing. However, such devices are disadvantageous in that the training golfer frequently optimizes his or her technique exclusively in the presence of such a device, and therefore tends to be induced to apply the wrong techniques in the absence of such golf-swing training apparatuses, i.e. with no restriction of his or her movements. For example, the Japanese patent document JP 2.001. 104.531 discloses a belt system that is worn by the training golfer around the hips, and highly limits the movements of the arms of the training golfer in their degrees of freedom, in order to suppress in that manner any excessive raising of the head end of the golf club, which counteracts a perfect golf club swinging technique. Furthermore, the systems leave the golfer with too few degrees of freedom for optimizing the response, the swing, the swing-through, and the downward swing under individual sequences of movement.

In order to learn how to swing the golf club along a circular line with only minor restriction of movements, training devices for learning how to swing a golf club are available that are reminiscent of a gyro-wheel. Such devices offer the training golfer a guiding line for supporting the golf club while swinging it. Such golf training devices, however, have the drawback that even though the golf club can follow said ideal line along the shaft, such training equipment fails to take into account the position of the golfer and the relative position of the golf club within such an ideal line. Canting is possible, and the achievable learning effect is consequently extremely low.

SUMMARY OF THE INVENTION

Therefore, the problem of the present invention is to provide a training apparatus that does not deny the training golfer any freedom of movement and offers him or her an ideal line for exercising the golf swing, whereby the training golfer is given the possibility to control the angle of the golf club in a superior way, and to optimize in particular the downward swing.

The problem is resolved according to the invention in that two guide rings are available, which are positioned on approximately the same plane, and are received in a support at least partly spaced from each other, whereby the two guide rings are approximately ellipsoidal and are designed to support the golf club. Further advantageous embodiments of the invention are specified in the dependent claims.

By virtue of the fact that provision is made for guide rings as defined by the invention, the training golfer is given the opportunity to bring his or her golf club in contact with the guide rings along the latter and carry out the swing, whereby such golfer can make sure both in the lower and upper areas that the club is held in the optimal position, and the training golfer can particularly control at any time through constant friction contact between the golf club and the guide rings whether the golf club is in contact with the guide rings. It is necessary for said purpose to guide the golf club along the plane set up by the two guide rings, whereby the individual response angle is maintained simultaneously. By constantly controlling the training swing, the golfer thus can constantly improve his or her skill and simultaneously follow the preset ideal line, so that a learning effect ensues very quickly in order to safely accomplish a golf swing for achieving a maximum range with minor application of force. Owing to the simple structure of the training apparatus, it is advantageously possible to set up the latter in a garden and to carry out the training exercises without a ball, so that the apparatus is also excellently suited for any location outside a golf course. Alternatively, the training device can be used jointly with a catching net as well, so that such training exercises can be carried out also with a ball. Furthermore, its simple structure permits the training apparatus to be adapted to the given size of the training person and the required response angle, thus permitting it to be used in a variety of different ways.

The two guide rings are arranged in this connection in such a way that they describe the ideal line for a golf swing with respect to form and size, whereby the golf club has to be in continuous contact with the two guide rings as the golf swing is being carried out.

The special advantage of the training apparatus as defined by the invention lies in that the two guide rings are designed for a golf club to be in contact with them, whereby the club can be placed on the two guide rings and guided along said ideal line, following the latter. In the ideal case, the golf club is in contact with both guide rings. Such contact is accomplished by the training golfer via the golf club, so that the training golfer can improve his or her golf swing by constantly controlling it and finally following the ideal line.

With another alternative embodiment, provision is made that the two guide rings describe an inner and an outer limit of a dynamic curve of the line for a golf swing, whereby an element secured on the golf shaft in the center of gravity of guidance can be arranged between the two guide rings, and thus always should be disposed between the two guide rings, so that any deviation from said ideal line is noticeably sensed when said element comes into contact with the guide rings.

The two guide rings can be secured on a mounting device set up on the floor or ground in such a manner that the outwardly facing guide surfaces are freely accessible over the entire circumference, whereby the two guide rings may be held freely suspended otherwise at an angle of inclination relative to the horizontal as well, so that the golf club guided past both guide rings leads to noticeable contact with the latter.

The mounting device usefully consists of a pedestral that can be set up on at least one, but also on two standing legs set at an adjustable angle relative to the vertical, whereby the guide rings and the mounting device are detachably joined with one another irrespectively of said angle, said mounting device particularly being adapted for folding it together. Alternatively, it is possible to design the two guide rings in such a way that they can be folded together in about the centerline of the mounting device. In this way, the training apparatus can be space-savingly stored, for example in a garage. The two standing legs are pivot-mounted on the mounting device, and can be loosely guided in a guide or held via a chain limiting the maximum deflection. For changing the response angle, it is possible for the training golfer to adapt the response angle to uneven grounds as well to his or her preferences, by unilaterally lifting the training apparatus, e.g. on the guide rings.

Thus the training apparatus can be adapted to the individual requirements of the training golfer, whereby the mounting device permits variable adjustment of the angle of inclination, and the angular position can be optimally adjusted in accordance with the response angle of the golf club between the plane described by the guide rings and the horizontal set-up surface.

Furthermore, according to the invention, the training apparatus has a freely mountable switch lifting off the golf club sliding past the guide rings from the plane of the latter. What is achieved in this way is that the golf club, when swung fully through, i.e. the part of the golf swing following the moment of impact at which the face of the club hits the ball, is lifted off from the plane in the ideal position. The ideal position is disposed in this connection at the level of the head of the golfer, i.e. long after the ball has been touched, so as to influence the movement of the club in such a way that the swing is carried out completely up to the end point, where the club is held behind the back of the golfer.

The switch is preferably plugged to the training apparatus by means of a plug mechanism comprising two recesses, and is seated on a fastening bolt, on the one hand, and, with a stop means, adjoins at least one guide ring, on the other, and thus can be secured in different positions of the golf-swing training apparatus. The ideal position of lift-off of the golf club from the curve described by the ring can be adjusted in this way for the individual golfer.

It is particularly preferred in this connection that the plug positions are arranged on the training apparatus in a way such that the ideal position is adjustable both for left- and right-handed golfers. The plug positions are provided for that purpose symmetrically mirror-inverted on corresponding sides of the guide rings.

The rings of the training apparatus may have a T-profile, whereby the rings are secured with their horizontal base on the pedestral, and the edge of the vertical profile guides the golf club. Alternatively, the T-profile may be secured on the pedestral with the vertical base, with the horizontal surface guiding the golf club. With either design, the surface of the T-profile can be provided with a polymer coating particularly in the site where contact takes place between the golf club and the T-profile, in order to reduce the sliding friction between the gold club and the profile.

According to a further development of the invention, provision is made that at least the outer guide ring has two symmetrical, trough-shaped deepenings deviating from the upper dead center of the ellipsoidal form. Said recesses receive a stop element, which is pivot-mounted in the upper dead center of the guide rings, for example on a crossbar provided there, and the movement of the golf club, when swung upwards, is limited by a stop protruding into the plane of the guide ring. Said stop means can be pivoted, so the training apparatus can be used by both left- and right-handed golfers, said stop means coming to rest in the one or other trough-like deepening accordingly.

So that the swing is optimized, for example close to the response point, provision can be made, furthermore, for a braking element which, when the swing is inadequate, will slow down the golf club, inhibiting the swing, so that the training golfer has to improve his or her exertion of force and the speed of the club. The braking elements may consist of magnets or braking surfaces formed between the guide rings in the upper and/or lower areas, such braking surfaces responding to the golf ball, for example only in the direction of the swing, and consisting of slanted bristles or rubber lips.

For the purpose of improving the position of the training golfer, the guide rings have a magnetic surface and are magnetizable, or are fitted with magnets pulling a metallic or magnetic field-reinforced shaft of the golf club against the guide rings, whereby in the case of magnetized rings, the neutral zone of the magnetized guide rings is disposed in the plane set up by the guide rings. In this way, it is assured that the magnetic force supposed to hold the golf club on the rings is evenly distributed along the golf swing.

For analyzing the golf swing, the guide rings alternatively can be equipped with sensors, sensor transmitters, or electrical contact surfaces, e.g. conducting paths, on the sliding side of the rings, whereby the contact surfaces can be divided in individual sectors, permitting the swing to be analyzed electronically.

For the purpose of raising the learning effect of the training apparatus for learning the golf swing, the golf club is provided with an element in the center of gravity of the club. Said element consists of at least one, preferably two semi-cups and a recess for the shaft of the club, whereby the two semi-cups are connectable with one another, or the element for the golf club consists of one single piece and can be plugged onto the golf club. Said element may serve the purpose of causing the training golfer to sense any digression of the golf club from the ideal line as such golfer is swinging the club.

Another embodiment of the training apparatus for learning the golf swing is characterized in that the golf club is fitted above and below said element with sensors or sensor transmitters. In this way, the golf swing is monitored throughout the swinging movement, permitting later control, so that the training apparatus can be used for continuously improving the golf swing by constantly exercising it.

The training apparatus may consist of different materials, i.e. the mounting device and/or the guide rings may be made of, e.g. wood, a polymeric material, a composite material, or a metal.

The profiles of the guide rings may be designed in different ways as well. For example, the guide rings may consist of a tubular profile, a T-profile, an H-profile, an L-profile, a semi-cup profile, or an X-profile, whereby the edges touching the golf club may be provided with a polymeric coating reducing the sliding friction.

BRIEF DESCRIPTION OF THE DRAWINGS

The exemplified embodiment described in the following is specified by way of example of the invention without, however, limiting the latter.

In the following.

DETAILED DESCRIPTION OF PREFERRED EMBODIMENTS

Figures 1, 2:
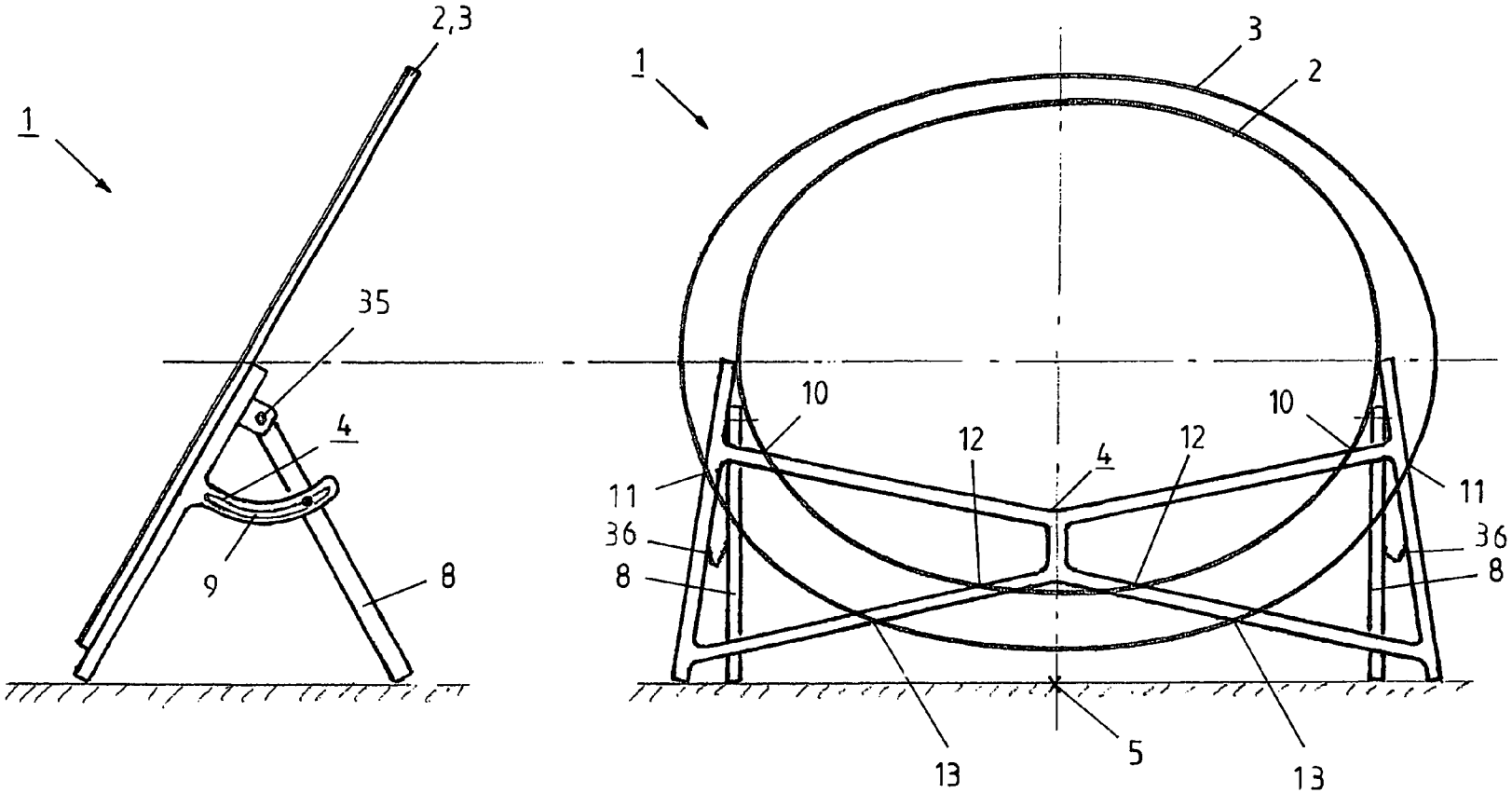
FIG. 1 is a side view of a golf swing training apparatus.
FIG. 2 is another side view of the golf swing training apparatus according to FIG. 1.

FIG. 1 shows a side view of an exemplified embodiment of the training apparatus 1, with the two guide rings 2 and 3 disposed one in the other, and with a mounting device 4 with infinitely variable angle adjustment, and a response position 5.

The two guide rings 2 and 3 are held by the pedestal 4, whereby the latter consists of a cross-like arrangement of struts, on which the two standing feet 8 are articulated, which can be folded down. The angle can be adjusted via a curved connection element 9, which is joined with the two feet of the pedestal 4, forming one piece with each of said feet.

FIG. 2 shows a front view of the same embodiment of the training apparatus 1 as the one represented in FIG. 1. In FIG. 2, the inner guide ring 2, the outer guide ring 3, as well as the fastening positions 10, 11, 12 and 13 of the guide rings 2 and 3 are visible on the mounting pedestal 4. The maximum mounting angle of the pedestal 4 is limited via a chain 36.

Figure 3:
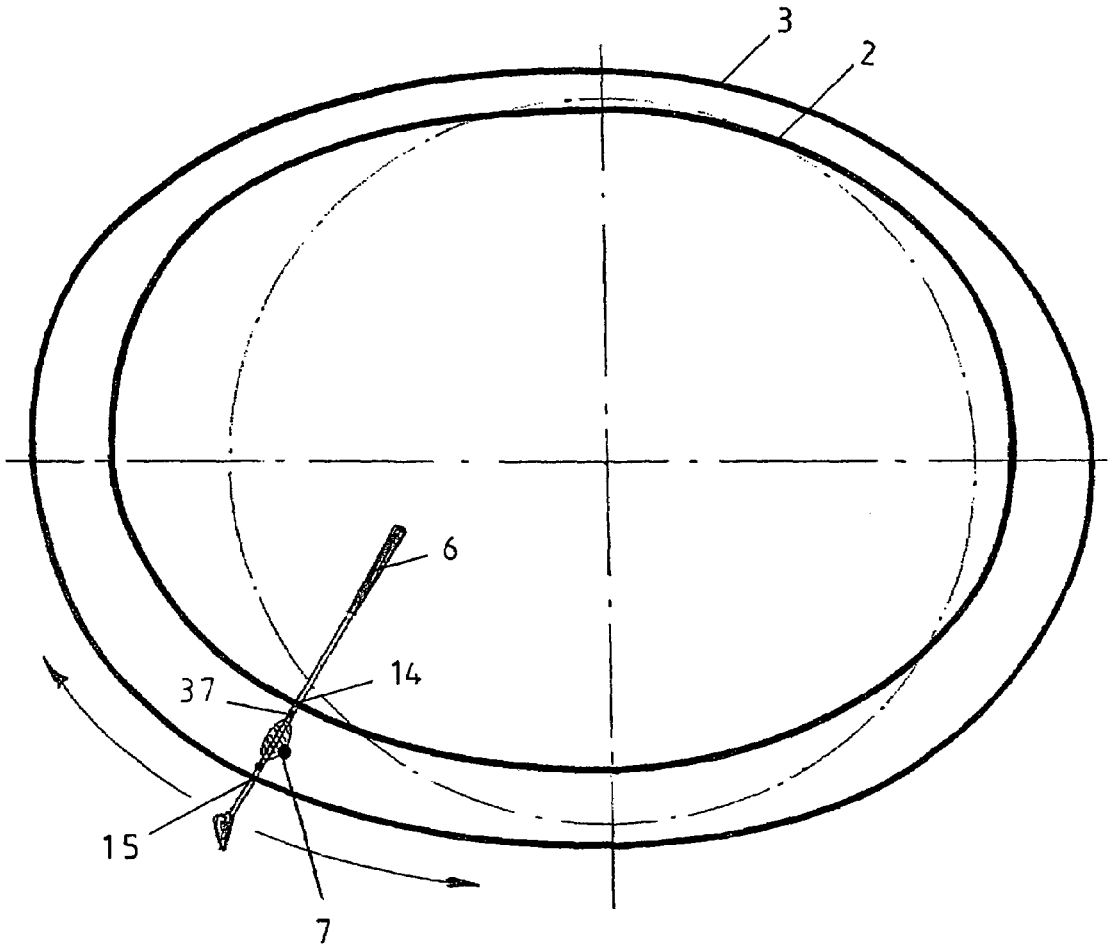
FIG. 3 shows how the two guide rings are arranged in relation to one another.

FIG. 3 shows the front view of the same training apparatus 1 with omission of the pedestal 4. Furthermore, the support points 14 and 15 supporting the golf club 6 on the two guide rings 2 and 3, as well as the direction of swing, and the direction in which the golf club is swung downwards, are shown as well. FIG. 3 thus substantially shows the ideal line for the golf swing, whereby the golf club 6 has to be guided along the guide rings 2 and 3, leading to perceivable contact with the latter. Alternatively, an element 7 may come to rest between the two guide rings 2 and 3, said element being secured on the shaft of the golf club 6, so that in case of any digression from the ideal line, a noticeable contact of the element 7 with the guide rings 2 and 3 will occur. The shaft of the golf club can additionally be equipped with sensors 37.

Figure 4:
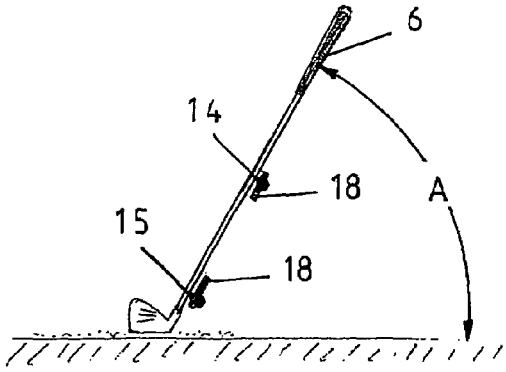
FIG. 4 is a side view of the guide rings in contact with a golf club.

FIG. 4 shows by a side view the golf club 6 as well as the magnets 16 and 17 mounted on the golf club 6, said magnets retaining the golf club 6 on the two guide rings 2 and 3 as the golf swing is being carried out. In addition, FIG. 4 shows the response angle "A".

Figure 5:
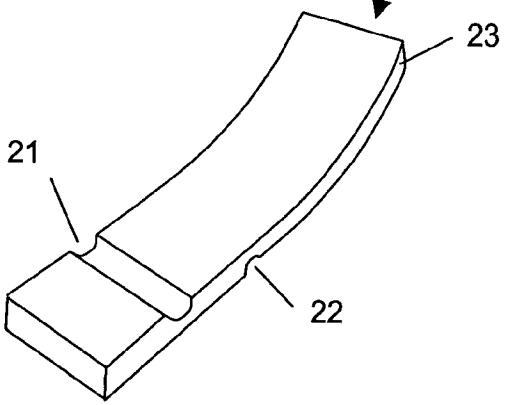
FIG. 5 shows a guide switch as defined by the invention for lifting off the golf club from the rings.

FIG. 5 is a representation of a guide switch 20 as defined by the invention, which has the two recesses 21 and 22 and a bent guiding element 23. The two recesses 21 and 22 comprise the connecting elements 25 and 26, which connect the two guide rings 2 and 3 with one another.

Figure 6:
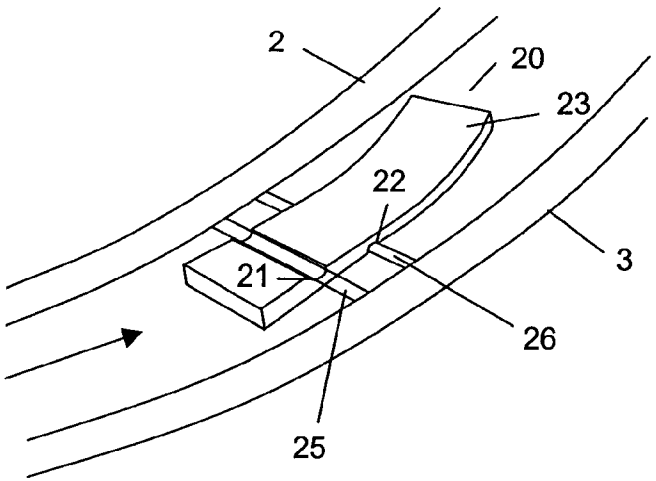
FIG. 6 is a perspective view of the guide switch as defined by the invention in the installed condition.

FIG. 6 is a perspective view of the guide switch 20 in its installed position, with the recesses 21 and 22 gripping all around the connecting elements 25, 26, which connect the two guide rings 2 and 3 with one another. As the golf club is sliding across the rings 2 and 3 in the direction as indicated by the arrow, the golf club is lifted off from the plane of the guide rings 2 and 3, which means the golf club is no longer guided through the two guide rings, and as a consequence of the swing, the golfer has to guide the golf club with his or her free hands up to the upper end position accordingly.

Figure 7:
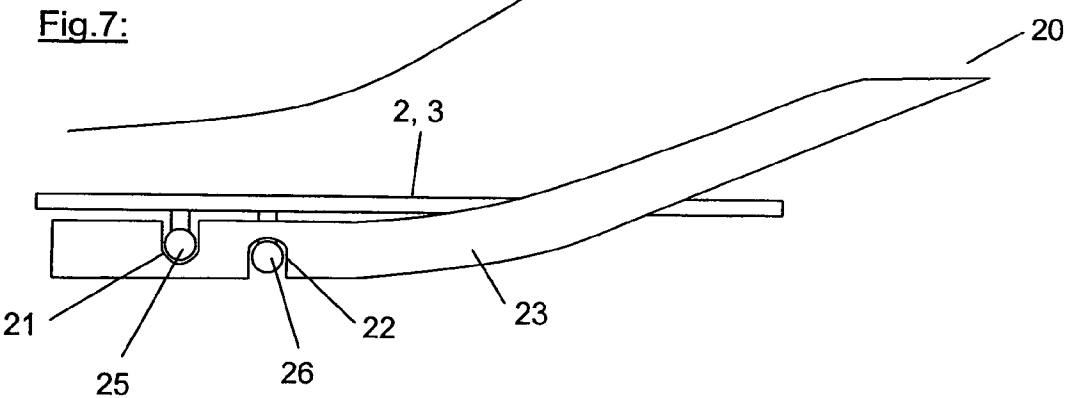
FIG. 7 is a side view of the guide switch as defined by the invention according to FIG. 6.

The same guide switch as the one shown in FIGS. 5 and 6 is represented in FIG. 7 by a side view. The guide switch 20 grips in the present connection around the connecting elements 25 and 26 from different sides, so that said elements are pressed into the connecting elements 25 and 26 due to the load exerted by the golf club. A golf club sliding in this connection on the plane, or along the structure of the guide rings 2, 3, is lifted off from said plane by the guide switch 20, and in doing so describes the path indicated by the arrow shown. Alternatively, it is possible to make provision for self-clamping recesses 21, 22, or to hold the guide switch 20 between the guide rings on the connecting elements 25, 26 by spring force.

Figure 8:
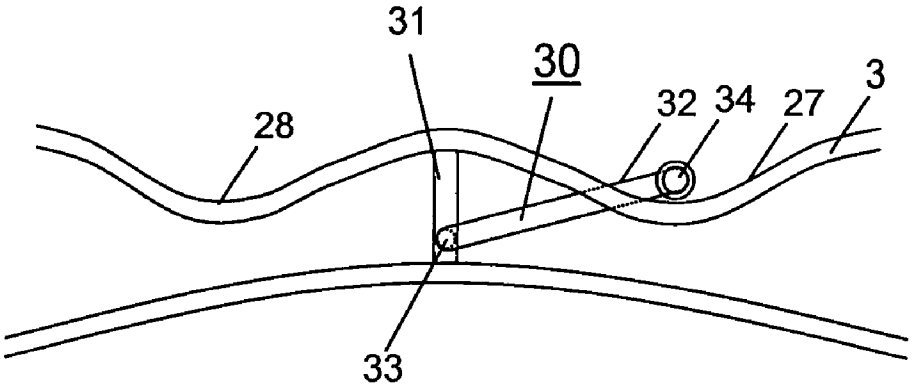
FIG. 8 is a side view of the stop element as defined by the invention.

FIG. 8 shows a side view of the stop element 30 as defined by the invention, which is pivot-mounted and secured on a crossbar 31 of the two guide rings 2, 3. The stop element 30 consists of a first profile piece 32, for example an angled or flat profile, which is supported on the crossbar in the center of rotation 33, and has a stop 34 at the diametrically opposed end. The stop element 30 can be displaced from the right side, trough-like deepening 27, to the left-side, trough-like deepening 28, so that the training apparatus 1 can be used by both right- and left-handed golfers. As the golf club is being swung upwards, it is driven along the guide rings 2, 3 up to the stop 34 before the return swing is initiated.

Figure 9:
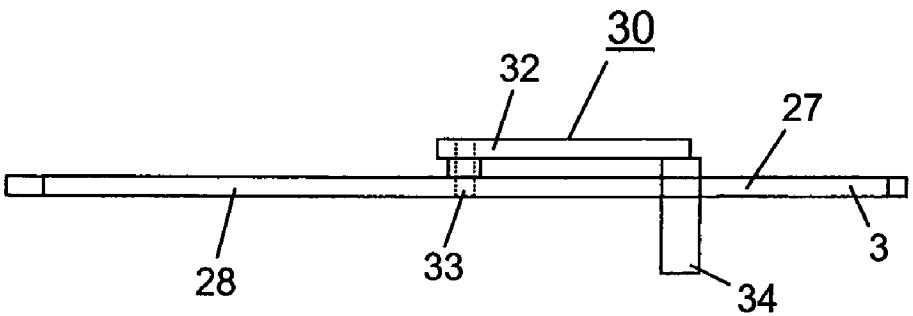
FIG. 9 is a side view of the stop element according to FIG. 8.

FIG. 9 shows the stop element 30 again by a top view, which shows that the stop 34 protrudes vis-à-vis the plane of the guide ring 3.

Figure 10:
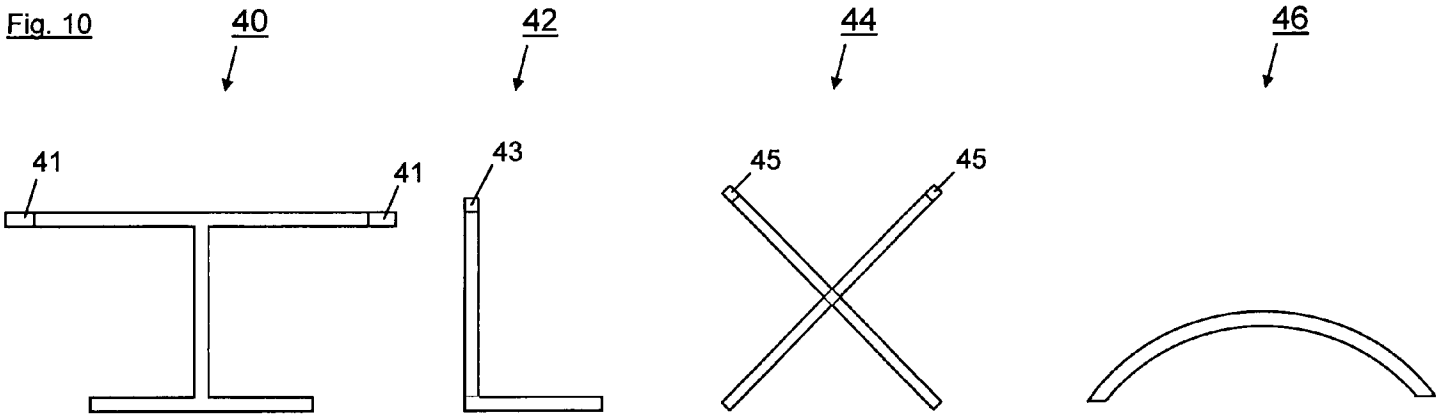
FIG. 10 shows several profiles that can be used for the production of the guide rings.

FIG. 10 shows several alternative profiles that can be used for the production 40 of the guide rings 2, 3. This can, for example, be a H-profile that is additionally equipped with magnets 41. The magnets 41 are used to control the club conduction. A further profile 42 is illustrated in an L-form and has a sensor 43 at at least on side. A further profile 44 is also equipped with sensors 45, whereas a profile 46 shows an arch-shaped profile. Optionally also magnets, instead of sensors 43, 45, can be used on profiles 42, 44 and 46, that lead to a braking of the golf club.

Figure 11:
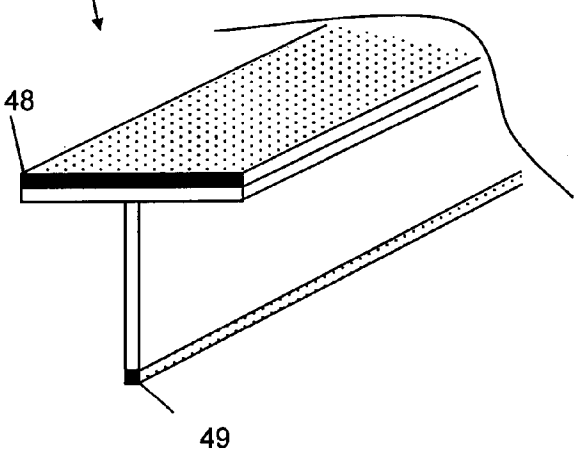
FIG. 11 shows a further development of the profiles by means of an embodiment.

FIG. 11 shows a T-profile 47, which has a coating 48 on one flat outer side. The coating 48 can either consist of a brake contact surface or it can also be a magnetic surface, which also leads to a braking of the golf club. Alternatively, it is conceivable that a sliding surface is applied on the profiles 40, 42, 44, 46 and 47, in order to either increase the sliding ability of the golf club shaft at least in the areas of the guide rings or a retardation is made. It is also conceivable that it involves magnetic surfaces and/or sensor surfaces as were indicated by the other profiles in order to control the conduction of the golf club. It is also possible to provide a coating 48 on the front surface instead of plane coating 48.

The golfer sets up the training apparatus 1 at its response angle "A", which is described by the training apparatus 1, and through the plane of the guide rings 2, 3 and the horizontal, and assumes in the training apparatus 1 the response position according to FIGS. 1 and 2. For carrying out a golf swing, the learning golfer slides the golf club 6 along the two guide rings 2 and 3, and senses a direct contact with the two guide rings 2, 3. If an element 7 is additionally mounted on the golf cub 6, the golfer must not touch either the inner guide ring 3 or the outer guide ring 2 as the shaft of the golf club is sliding along the guide rings 2, 3 in the direction of the swing, touching the two guide rings 2, 3 in the positions 14 and 15. For limiting the upward swing, provision is made for a stop element 30, whereas for reaching the optimal position after the golf swing has been completed, the guide switch 20 lifts off the club from the guide rings 2, 3, and initiates a movement to behind the head of the training golfer.

In a preferred embodiment of the golf swing training apparatus, either the golf club has a magnet 18 in the positions 16 and 17, and/or the guide rings 2, 3 as such are magnetic, so that the magnetic force of the magnets 8 in the positions 16 and 17 retains the golf club 6 on the guide rings 2, 3, thus supporting the learning golfer in finding the ideal line and position of the golf club 6 while swinging the latter. In addition, it is possible to make provision for a braking element in the upper and/or lower areas, which slows down the swing, thus causing the golfer or training person to carry out a swing with exertion of higher force and an improved swing.

LIST OF REFERENCE NUMBERS

1 Training apparatus
2 Guide ring
3 Guide ring rotation
4 Mounting device
5 Response position angle
6 Golf club
7 Element
8 Standing foot
9 Connecting element
10 Fastening position
11 Fastening position
12 Fastening position
13 Fastening position
14 Support point
15 Support point
18 Magnet
20 Guide switch
21 Recess
22 Recess
23 Guide Element
25 Connecting element
26 Connecting element
27 Deepening
28 Deepening
30 Stop element
31 Crossbar
32 Profiled piece
33 Center of
34 Stop
"A" Response

What is claimed is:

1. A training device for golf swings comprising first and second guide rings arranged in a mounting device at least partly spaced from one another and extending in a plane inclined in relation to the horizontal, whereby the first and second guide rings have an approximately ellipsoidal and self-contained shape, whereby a golf club is placeable on the first and second guide rings and guidable along an ideal line for a golf swing;

wherein each guide ring has a respective guiding surface that guides to one side of said plane, the guide rings being freely accessible from said one side.

2. The training apparatus according to claim 1, wherein the first and second guide rings are otherwise mounted freely suspended at an angle of inclination relative to the horizontal corresponding with the angle of response (A) of the golf club.

3. The training apparatus according to claim 1, wherein a golf club guided past the guide rings leads to noticeable contact.

4. The training apparatus for golf swings according to claim 1, wherein the mounting device comprises a pedestal arranged at an adjustable angle relative to the vertical with at least one standing foot, or has two independent standing feet pivot-mounted for being loosely guided by a connecting element, or limited in their mobility by a chain.

5. The training apparatus for golf swings according to claim 4, wherein the guide rings and the mounting device are detachably connected with one another, and the mounting device can be folded together and/or the guide rings can be folded together via a hinge.

6. The training apparatus for golf swings according to claim 5, wherein the mounting device and/or the guide rings are made of wood, a polymeric material, a composite material, or of metal.

7. The training apparatus for golf swings according to claim 6, wherein the guide rings comprise a tubular profile, a T-profile, an H-profile, an L-profile, a semi-cup profile, or an X-profile.

8. The training apparatus for golf swings according to claim 1, wherein a guide switch is arranged on the guide rings for lifting off the golf club sliding past said guide rings from said guide rings.

9. The training apparatus for golf swings according to claim 8, wherein the guide switch has recesses for plugged mounting, and rests on a fastening bolt, on the one hand, and with a stop against at least one guide ring on the other.

10. The training apparatus for golf swings according to claim 9, wherein different mounting positions are available.

11. The training apparatus for golf swings according to claim 1, wherein the guide rings comprise T-profiles secured with their horizontal base on a support, said profiles guiding the golf club with the edge of the vertical base.

12. The training apparatus according to claim 1, wherein the guide rings comprise T-profiles secured with their vertical base on a support and guiding the golf club with the horizontal base.

13. The training apparatus for golf swings according to claim 12, wherein the surface of the guide rings touching the golf club as the golf club is swinging, are provided with a polymer coating reducing the sliding friction.

14. The training apparatus for golf swings according to claim 13, wherein the first guide ring is an outer guide ring having two symmetrically arranged, trough-like deepenings deviating from the ellipsoidal shape in the upper dead center.

15. The training apparatus for golf swings according to claim 1, wherein provision is made for a stop element in the upper dead center of the guide rings said stop element being pivot-mounted and secured on a crossbar; and wherein the movement of the golf club, when swinging upwards, is limited by a stop protruding into said plane.

16. The training device for golf swings according to claim 15, wherein magnets are arranged in the upper and/or lower areas of the guide rings, or in defined segmental areas, whereby the retaining force of said magnets has to be overcome as the golf club is being guided past said magnets.

17. The training apparatus for golf swings according to claim 16, wherein braking surfaces are formed between the guide rings at least in an upper and/or lower area, said braking surfaces responding to the golf ball only, in the swinging direction, and comprising slanted bristles or rubber lips.

18. The training apparatus according to claim 17, wherein the guide rings have a magnetic surface or are magnetizable or fitted with magnets, said magnets pulling a metallic or magnetic field-reinforced shaft of the golf club against the guide rings.

19. The training apparatus for golf swings according to claim 18, wherein the neutral zone of the magnetized guide rings is disposed in the plane set up by the guide rings.

20. The training apparatus for golf swings according to claim 19, wherein the guide rings are equipped with sensors, sensor transmitters or electrical contact surfaces on the side disposed perpendicularly to the normal of the plane, whereby the contact surfaces are divisible in individual sectors, and an electronic evaluation of the swing can be carried out.

* * * * *